US005873346A

United States Patent [19]

Haberland

[11] Patent Number: 5,873,346

[45] **Date of Patent: *Feb. 23, 1999**

[54] FUEL INJECTION PUMP

[75] Inventor: Siegfried Haberland, Stuttgart, Germany

[73] Assignee: Robert Bosch GmbH, Stuttgart, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 663,205

[22] PCT Filed: Sep. 20, 1995

[86] PCT No.: PCT/DE95/01289

§ 371 Date: Jun. 12, 1996

§ 102(e) Date: Jun. 12, 1996

[87] PCT Pub. No.: WO96/12103

PCT Pub. Date: Apr. 25, 1996

[30] Foreign Application Priority Data

Oct. 12, 1994 [DE] Germany ..... 44 36 416.4

[51] Int. Cl.[6] ..... F02M 41/00

[52] U.S. Cl. ..... 123/449; 123/495

[58] Field of Search ..... 123/449, 450, 123/495

[56] References Cited

U.S. PATENT DOCUMENTS

| | | | |
|---|---|---|---|
| 4,082,072 | 4/1978 | Johnson | 123/495 |
| 4,763,631 | 8/1988 | Fehlman | 123/449 |
| 5,191,868 | 3/1993 | Kraemer | 123/449 |

FOREIGN PATENT DOCUMENTS

| | | | |
|---|---|---|---|
| 0076508 | 4/1983 | European Pat. Off. . | |
| 8805128 | 7/1988 | European Pat. Off. | 123/449 |
| 3429128 | 2/1986 | Germany | 123/449 |
| 59-20 38 62 | of 0000 | Japan . | |
| 0102423 | 8/1979 | Japan | 123/449 |
| 59-203862 | 11/1984 | Japan . | |

*Primary Examiner*—Carl S. Miller
*Attorney, Agent, or Firm*—Edwin E. Greigg; Ronald E. Greigg

[57] ABSTRACT

A fuel injection pump is proposed, with an annular slide (20) that is displaceable on the pump piston by a governor and that has a control edge by which a relief conduit of the pump work chamber can be opened in the course of the pump piston supply stroke; the relief conduit portion emerging from the jacket face of the pump piston is embodied as a radial bore (18), and the fuel stream emerging from it is deflected by a deflection face (34) on the annular slide or a deflection face (76) on the pump piston, in such a manner that the stream is deflected out of the radial plane, avoiding axially active pressure zones, so that varying axial loads resulting from the various diversion events on one another on the control slide are avoided, and thus fluctuations in injection quantity from one injection event to another and the strain on parts of the governor are reduced as well.

11 Claims, 3 Drawing Sheets

FUEL INJECTION PUMP

PRIOR ART

The invention is based on a fuel injection pump as set forth hereinafter. In one such fuel injection pump, known for instance from European Patent Disclosure EP-A 0 444 279, the annular slide is embodied as a cylindrical annular disk with flat end faces. One of the end faces, together with the inner bore of the annular slide, forms an encompassing control edge, at which the outlet cross section of the radial bore is opened upon a reciprocating motion of the pump piston. The position of the annular slide is set with the aid of a governor lever combination; one of the levers, via an actuating head, engages a corresponding recess on the jacket face of the annular slide and puts the annular slide into a desired position in accordance with the motion of the lever. In this arrangement, after the radial bore is opened by the control edge, a diversion stream occurs, which is aimed radially and is located in a different angular position relative to the stationary pump housing in the stationary annular slide, depending on the rotary motion of the pump piston in each supply stroke of the pump piston. This embodiment has the disadvantage that the diversion stream sweeps over the flat face of the face end of the annular slide, so that a region of lower pressure forms between the diversion stream and the end face of the annular slide; this lower pressure exerts a force on the annular slide with the effect that the annular slide can move axially upward in the direction of the pump work chamber, within the limits of the possible play between its coupling to the governor lever or the play and resiliency of the governor lever combination. Because of the variable angular position of the diversion stream and the resultant different geometry of the adjacent diversion chamber with the governor and with springs that restore the position of the pump piston, the effects of the motion of the annular slide are variably pronounced. Since on the other hand throttling of the diversion stream occurs as a result of an adjustment of the height of the annular slide, resulting in different times before the relief of the pump chamber has progressed far enough to interrupt the injection. The consequence is accordingly undesired deviations of the injection quantities from one stroke to another.

ADVANTAGES OF THE INVENTION

The fuel injection pump of the invention has the advantage that as a result of the fuel stream deflected at an angle to the radial plane, the effect of the pressure reduction between the fuel stream and the face end of the annular slide and of the various pressure fields in the diversion chamber that are affected by the geometry of the diversion chamber is reduced, and thus the oscillating axial motions of the annular slide within the limits of the mechanical play or possible degrees of freedom of the governor are made uniform, and a reduction in injection quantity deviation is achieved. In addition, a reduction in the forces exerted on the annular slide upon diversion is obtained, which means less stress on the parts that actuate the annular slide.

The fuel injection pump of the invention has the advantage that deflection faces on the annular slide can be achieved in a simple way. In accordance with the advantageous features set forth, such a deflection face can also be effectively disposed on the pump piston. An advantage is that the diversion stream, in fuel injection pumps that function with control of the end of supply, is aimed in the direction of the supply stroke motion of the pump piston.

With the features set forth, by means of the annular face adjacent to the control edge, first the necessary clearance for unhindered relief of the pump work chamber exists. Then because of the achievement of the deflection face, which is transverse to the diversion stream, the aforementioned axial forces are reduced because of pressure differences between the diversion stream and the surface of the annular slide, and because of the geometry of the adjacent diversion chamber, the annular side in the axial direction of the pump piston relative to the housing part receiving the pump work chamber and defining the diversion chamber is embodied more uniformly than crosswise to the pump piston axis. Thus the reactions of the annular slide become more similar and less dependent on the angular position of the diversion stream. Hence the diversion stream exerts a uniform radial force component and for the above reasons also a more-uniform, but compared with the version of the prior art a lesser axial force component on the annular slide.

Preferably, the deflection face is embodied as an annular wall that is at right angles to the annular slide surface, which can be formed by making a notch on the face end of the annular slide. In another feature a shaped part is mounted on the face end of the annular slide and forms this annular wall that is perpendicular to the face end and points toward the pump piston. For a secure fixation of the shaped part on the annular slide, the shaped part can have a circumferential collar, with which the shaped part engagingly surrounds the annular slide and thus also brings about accurate centering of the annular wall toward the axis of the pump piston or toward its surface. With this embodiment, an exact control edge can be made in technically optimal fashion before the shaped part is mounted on the annular slide. The shaped part may, be reduced in wall thickness at its outer circumference, in order to reduce the mass in motion of the annular slide and to increase the outflow cross section between this shaped part and the adjacent housing wall of the fuel injection pump, in which housing the pump cylinder is disposed. As a result, the penetration through to the annular slide of pressure fields caused by the diversion stream in the diversion chamber is reduced. In a simple way, the shaped part may also be embodied as a shaped sheet-metal part, which is crimped inward on its face end. To permit a close enough approach of the annular slide to the flat housing wall opposite one face end when the space available is tight, an annular recess is made in the face end of the housing in the region of the protruding wedge of the shaped part, so that once again the adequate outflow cross section in the radial direction to the diversion chamber can be assured.

A modified embodiment set forth leads to a complete deflection of the diversion stream within the groove and thus assures a constant reaction force per diversion stream upon the annular slide. It is attained that once again the diversion stream can exert a uniform force component on the annular slide. In one version set forth it is attained that the emerging diversion stream can fan out immediately onto the annular slide with little feedback, and that at least some portions of this diversion stream will in turn be deflected by the deflection face, in such a way that the annular slide is loaded with only slight axial forces that are uniform per diversion stroke. Other features have has the same effect, where after deflection by the second deflection face, stream components that are still bent toward the annular slide can bounce off the first deflection face once again, thus avoiding a predominantly axial force component of variable size depending on the stream location.

BRIEF DESCRIPTION OF THE DRAWINGS

Eleven exemplary embodiments of the invention are shown in the drawing and will be described in detail in the ensuing description.

DETAILED DESCRIPTION OF THE EXEMPLARY EMBODIMENTS

Figure 1:
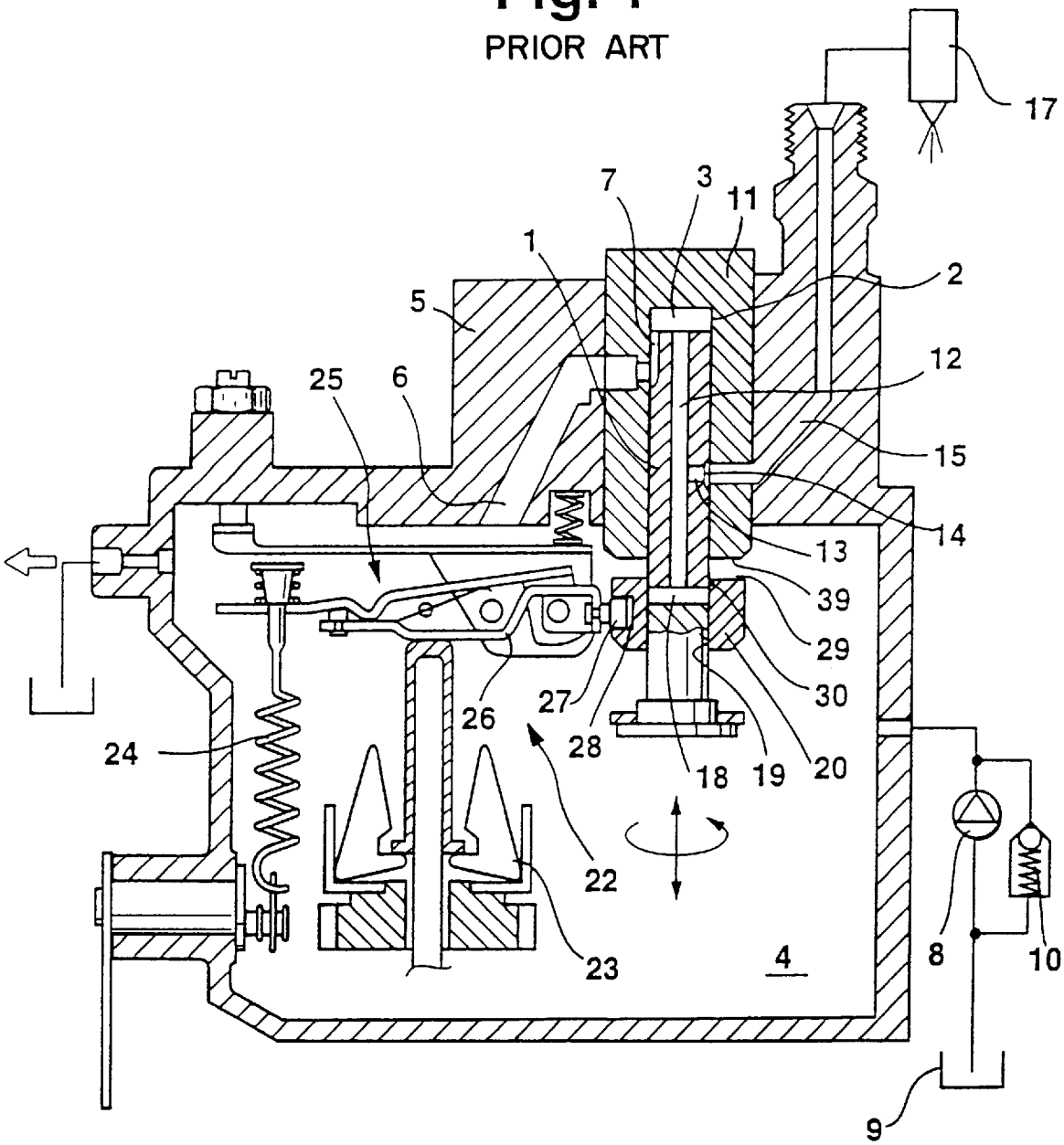
Fig. 1 PRIOR ART
FIG. 1 schematically shows a fuel injection pump with an annular slide of the generic type involving a distributor injection pump.

In a distributor fuel injection pump of the generic type in question, as shown in simplified and schematic form in FIG. 1, there is a pump piston 1, which is disposed, tightly displaceably and rotatably, in a pump cylinder 2 and which with its face end encloses a pump work chamber 3 in the pump cylinder. The pump piston is driven to reciprocate and at the same time rotate , as indicated by the arrows in the drawing, by means not shown in further detail, such as a cam drive. With its drive-side end, the pump piston protrudes into a suction and diversion chamber 4, in which typically the cam drive of the pump piston, lubricated with fuel, is also disposed. An annular slide 20 is disposed, tightly displaceably and rotatably on this part of the pump piston. From the suction chamber, the pump work chamber 3 is supplied with fuel in the intake stroke of the pump piston via a suction line 6 and via suction grooves 7, beginning at the face end of the pump piston, in the pump piston jacket face in the region where the suction line enters the pump cylinder 2. The suction chamber 4 receives the fuel from a feed pump 8 from a fuel tank 9 at a pressure determined by a pressure control valve 10 and the pumping of the pump. In the upward supply stroke of the pump piston, the fuel compressed in the pump work chamber 3 is carried via an axial bore 12 in the pump piston and via a radial bore 13 beginning there, to a distributor opening 14 on the jacket face of the pump piston. Through this opening, The fuel is delivered per pump piston supply stroke to one at a time of a plurality of injection lines 15, which are disposed at regular intervals around the pump cylinder 2 and are connected on their other end each to one injection valve 17 of the engine. The pump cylinder 2 is embodied here by a cylinder bush 11 inserted into the housing 5 of the fuel injection pump, whose face end 39 is opposite the face end 29 of the annular slide 20.

The pumping of the pump piston at high pressure, which pressure causes injection at the injection valve, takes place until such time as the pump piston with a radial bore 18 that merges with the axial bore 12, gets out of coincidence with the inner bore 19 of the annular slide 20. By means of the position of this annular slide 20, the effective injection stroke of the pump piston is determined, and thus so is the quantity of fuel to be injected. The position of the annular slide is varied with the aid of a governor 22, which has an rpm sensor 23, a variably prestressed governor spring 24, and a governor lever combination 25 with a control lever 26 that via a head 27 engages a recess 28 on the annular slide. In the process, the annular slide 20 exerts essentially no force on the governor lever combination 25 and easily displaceably follows the setting of the control lever 26. Instead of the mechanical governor shown, an electromechanical governor or a hydraulic governor may also be provided.

In the embodiment of the annular slide shown in FIG. 1, this annular slide is equivalent to the prior art. If the radial bore 18 is opened by the control edge 30 formed at the transition between the inner bore 19 and end face 29 of the annular slide, a diversion stream sweeps tangentially over the end face 29 at high pressure and thus at high speed. The reason why this strong stream forms is that the pressure in the control chamber 4 is very low in proportion to the injection pressure in the pump work chamber. Because of the high speed and the orientation of the diversion stream, a pressure is established between this stream and the end face 29 that is reduced compared with the remaining pressure in the diversion chamber and which has the tendency to move the annular slide 20 upward toward the work chamber. This motion is made possible because the governor 22 is resilient, because of the general tolerances in terms of play and because of a certain resiliency in the governor levers, even counter to the forces acting upon them. A certain play must normally also prevail in the connection between the head 27 and the recess 28. Because of this situation, the annular slide 20 executes unintentional axial adjustments and also certain tilting motions, which have various effects from one diversion event to another. This phenomenon is also promoted by the fact that the location of the radial bore 18, in the course of the various pump supply strokes, assumes various angular positions in the radial plane of the pump piston axis.

Figure 2:
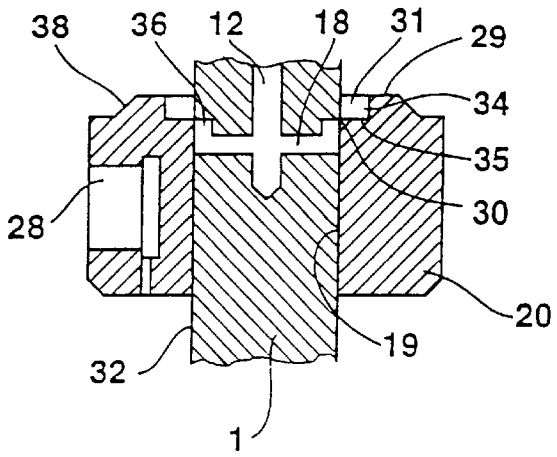
FIG. 2 shows a first feature of the invention in the fuel injection pump of FIG. 1.

These disadvantages are avoided with the embodiments of the annular slide and of the pump piston in the region of the radial bore 18 as described below. FIG. 2 shows a first embodiment of a provision to overcome this disadvantage. To this end, the annular slide 20, which will be referred to hereinafter by the same reference numeral for the sake of simplicity, despite its having a different design, has a notch 31 on its end face 29 that together with the jacket face 32 of the pump piston 1 forms an annular groove of approximately rectangular cross section. This notch has a circumferential wall 34 that is perpendicular to the end face 29 and forms a deflection face for the fuel stream emerging from the radial bore 18. Located between the annular wall 34 and the jacket face 32 of the pump piston is an annular face 35 that is parallel to the plane of the end face 29 and that at its transition with the inner bore 19 of the annular slide forms the control edge 30. The cross-sectional form of the outlet of the radial bore may be equivalent to the diameter of this bore in the interior of the pump piston, or it may be provided with an expanded portion 36 with boundary walls that are at right angles to the plane tangent to the jacket face of the pump piston.

If a connection is now made between the radial bore 18 and the diversion chamber 4 in the course of the pump piston supply stroke, then the fuel stream emerging from the expanded portion 36 strikes the deflection face 34 as indicated by the arrows, bounces back from it and then flows out into the diversion chamber 4. The kinetic energy of the diversion stream is thus substantially consumed at the annular wall 34 or deflection face 34, without any substantial axial force component on the annular slide arising. In any case, the situation is such that the diversion pulse acts essentially as a radial force component on the annular wall 34, so that uncontrolled axial motions of the annular slide are thus avoided. In contrast to the embodiment of the annular slide of the prior art, the diversion stream no longer flows out along the flat face end of the annular slide. In this course of the diversion stream of the prior art, an additional effect arises, which is brought about by the fact that in the adjacent diversion chamber, a changing geometry or depth is present, depending on the angular location of the diversion stream which it will be remembered varies from one supply stroke to another of the pump piston, and as a result of this changing geometry or depth the various pressure fields acting on the annular slide are created. The stream can also strike the governor lever directly, depending on its angular location, and can have various influences on the location of the annular slide. The compression springs leading back to the pump piston also represent obstacles to an outflow and act as pressure fields. In the case of the fuel spilling upward from the notch 31 toward the pump work chamber in accordance with FIG. 2, the fuel is counteracted by a chamber geometry that is the same, regardless of the angular location, as can be seen from FIG. 1. What has an effect there above all is the face end 39, located in a radial plane to the pump piston axis, which there defines the diversion chamber. The feedback effect of the diversion stream axially upon the annular slide is thus made more uniform, and the axially acting forces upon the annular slide are reduced, such that there is less strain on the parts that adjust the annular slide as well, especially the governor 22, so that the vulnerability to damage there is also reduced.

The end face 29 may also be stepped via an inclined surface 38, in the radially outer region. This has an advantage in terms of reducing weight and above all has advantages fluidically, because now in the region of the inclined face 38, upon approach of the annular slide to an opposed face end 39 of the housing, the fuel (see FIG. 1) can expand more rapidly, since sufficient expansion space is furnished between this end face and the annular slide. Pressure fields of the diversion stream now have virtually no further opportunity for engagement in this region, and in this way as well, influence on the annular slide position is thus reduced.

Figure 3:
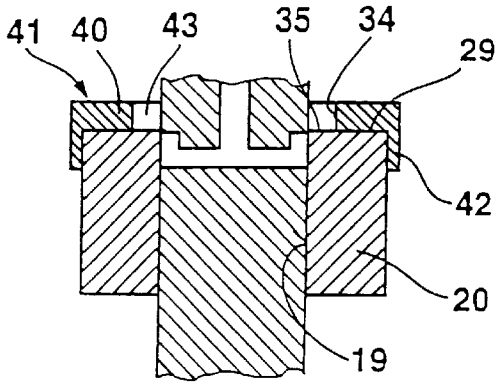
FIG. 3 shows a second feature of the annular slide with the shaped part mounted on it.

FIG. 3 shows an arrangement of the annular slide 20 that is embodied differently from FIG. 2. To form the annular wall 34, in this case a shaped part 41 is provided, which is embodied in the manner of a cap and is mounted on the face end 29 of the annular slide 20. It has a collar 42, surrounding the outer circumference of the annular slide, and in its disklike portion 40 resting on the face end 29 it has an axial bore 43, whose diameter is greater than the inside diameter 19 of the annular slide and thus leaves the annular face 35 free. The inner wall of the bore 43 then forms the annular wall 34 as a deflection face, which is perpendicular to the face end 29 of the annular slide and extends parallel to the axis of the pump piston. The shaped part is firmly joined to the annular slide 20. With this embodiment, the same result is attained as in the exemplary embodiment of FIG. 2. To adapt to the shape of the annular slide 20, however, the shaped part 41 as shown in FIG. 4 may be divided, in its portion 40 resting on the face end 29 of the annular slide and there forming an annular disk, into a thicker portion 45 adjacent to the bore 43 and an outer, thinner portion 44; at the transition between the thicker portion 45 and the thinner portion 44, an inclined face 38' is formed, analogous to the contour of the annular slide 20 of FIG. 2.

Figure 4:
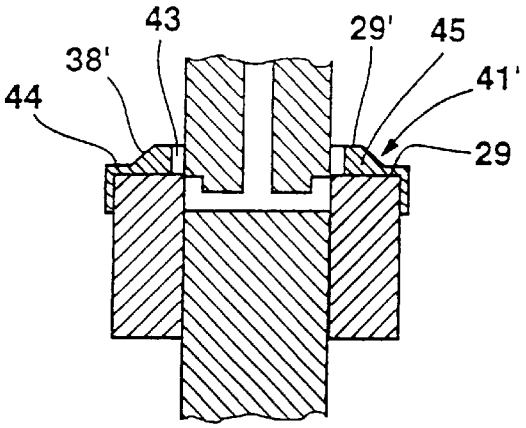
FIG. 4 shows a third exemplary embodiment with a modified form of the shaped part mounted on the annular slide.
Figure 5:
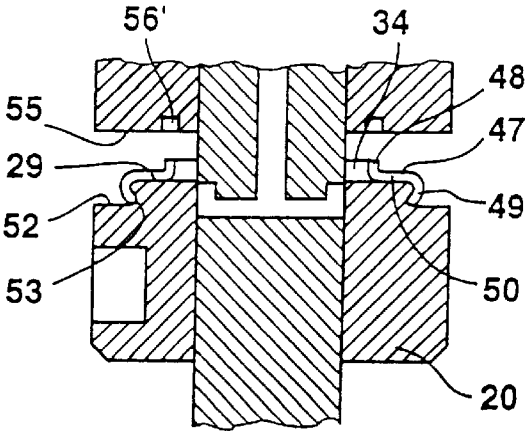
FIG. 5 shows a further version of a shaped part mounted on the annular slide, in the form of a shaped sheet-metal part.

Another way of making a deflection face in the manner of the embodiment of FIG. 2 is shown in FIG. 5. There, instead of a solid shaped part of the kind used in FIGS. 3 and 4, an annular sheet-metal part 4 is provided, with a first collar 48 formed out on the inside and with a second collar 49 on the outside, formed in the opposite direction. Between the two collars, the sheet-metal part forms an annular disk 50, which rests flat on the face end 29 of the annular slide. The first collar has a cylindrical inner wall, which forms the annular wall 34 and which as in the previous exemplary embodiments extends parallel to the jacket face of the pump piston 1. The outer, second collar 49 serves to secure the sheet-metal part to the annular slide. To that end, the collar has a notch 52, which is embodied as an annular shoulder of dovetail-like cross section; the second collar 49 is crimped inward into the undercut 53 of this cross section of the boundary wall, toward the pump piston, of the notch 52. In this way, a desired configuration of the deflection face can be varied in terms of its height and its distance from the pump piston surface.

Figure 6:
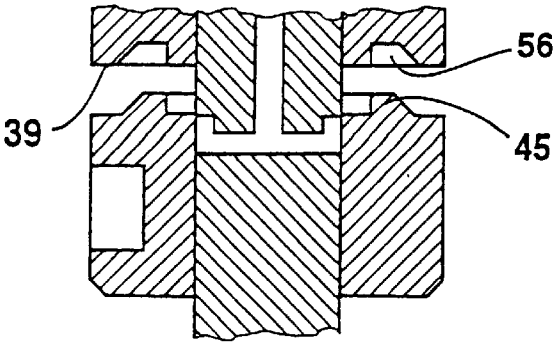
FIG. 6 shows a variant of the embodiment, attainable in the exemplary embodiments of FIGS. 2–5, by means of a housing adjoining the annular slide.

The above-described embodiments of FIGS. 2, 4 and 5 each have a part axially protruding from the radial plane in order to form the deflection face 34; in FIG. 5 this is the first collar 48, in FIG. 4 the thicker portion 45, and in FIG. 2 the portion corresponding to it on the face end of the annular slide 20. In accordance with FIG. 6, in order to allow a closer approach of the annular slide to this housing wall, and to allow working with existing space conditions which may also be dictated by the disposition of the governor and is necessary if there is an additional shaped part mounted on a given annular slide, an annular recess 56 is now machined into the end wall 39 of the cylinder 2 opposite the annular slide; this recess is approximately the same form as the aforementioned parts 48 and 45 but has a larger cross section. Thus these parts, like part 45 of FIG. 6, can plunge partway into this annular recess 56, which especially upon engine starting is necessary to produce a maximum fuel injection quantity for starting. In FIG. 5, another such annular recess 56' is provided, which is adapted to the shape of the first collar 48.

Figure 7:
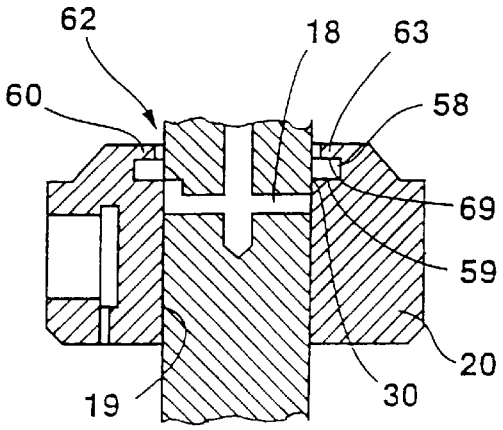
FIG. 7 shows a sixth embodiment with an annular groove machined into the annular slide.

A modified version is shown in FIG. 7. Here, an annular groove 58 is machined into the ends of the annular slide 20 toward the pump work chamber, beginning at the inner bore 19 of the annular slide; together with the inner bore 19, its boundary wall on the side toward the pump piston drive end forms the control edge 30. To allow an outlet for the fuel into the annular groove 58 when the radial bore 18 is opened by the control edge 30, the other boundary wall is shortened from its face end inward, so that an overflow cross section 62 is formed between the pump piston surface and the remaining end face 63. The fuel flowing out of the radial bore 18 is diverted in the annular groove 58 and then flows out at the overflow cross section 62. This prevents variable axial pulses upon the annular slide.

Figure 8:
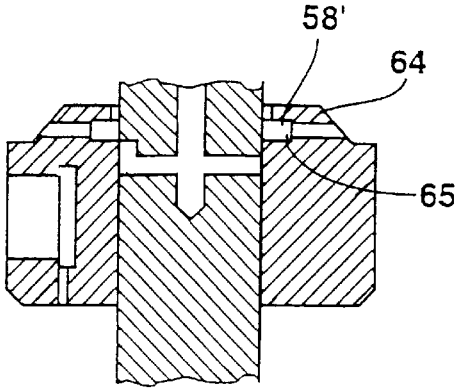
FIG. 8 shows a seventh exemplary embodiment in a modification of the embodiment of FIG. 7.

In a modification of FIG. 7, shown in FIG. 8 FIG. 8 shows an outlet out of the annular groove 58' that is created not by shortening the boundary wall but instead with the aid of a radial bore 64, which leads away from the bottom 65 of the inner annular groove 58. A plurality of such radial bores are provided on the circumference of the annular groove 58, to enable a sufficiently large outflow cross section. These provisions once again prevent variable axial components caused by flow effects from affecting the annular slide. The result attained is that deviations in injection quantity caused by incorrect positions of the annular slide are avoided.

Figure 9:
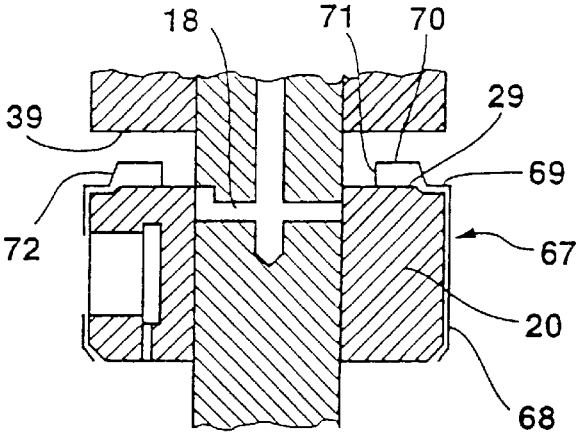
FIG. 9 shows an eighth exemplary embodiment where the exemplary embodiment of FIG. 7 is duplicated but using a sheet-metal part mounted on the annular slide.

An equivalent embodiment to the version of FIG. 4 is shown in FIG. 9. There, an annular sheet-metal part 67 is clipped onto the annular slide 20; it has a jacket part 68 circumferentially surrounding the annular slide; this part changes into a part 69 that is bent over onto the face end 29 of the annular slide; this latter part comes to rest with its face end on the end face 29, or a shoulder thereof, and after that is bent at an angle, with one portion 70 extending parallel to the end face 29 and another portion 71 then bent again at a right angle toward the face end 29, this latter portion in turn forming the deflection face, having an annular impact edge.

Figure 10:
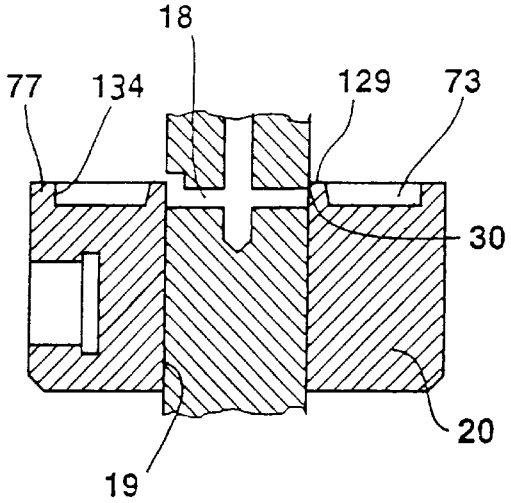
FIG. 10 shows a ninth exemplary embodiment with a deflection face on the outside.
Figure 11:
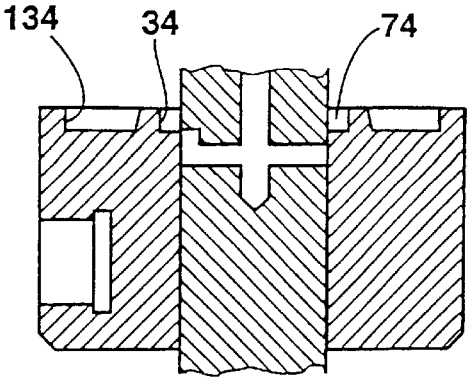
FIG. 11 shows a tenth exemplary embodiment with a second deflection face on the face end of the annular slide.

In the exemplary embodiment of FIG. 10, the annular slide initially has the typical straight end face 129, which with the inner bore 19 of the annular slide 20 forms the control edge 30. However, this end face 129 is embodied only as a narrow annular region, which directly adjoins an annular recess 73 in the face end of the annular slide, forming an annular collar 77 on the outer circumference of the end face of the annular slide, which collar in turn presents an annular wall 134, located at right angles to the face end, near the outer circumference of the annular slide. The fuel stream emerging from the radial bore 18 thus, because of the recess 73, is spaced apart from the surface of the annular slide, so that low-pressure zones cannot have any substantial effect. Finally, however, the fuel components flowing into the annular recess 73 are again deflected at the annular wall 134, as in the previous exemplary embodiments. This annular wall then receives only the radial remaining force components, without the annular slide thereby being unevenly acted upon axially. Once again, in a simple way, an annular slide can be furnished in which an adjustment of the annular slide dependent on the embodiment and angular location of the diversion streams is substantially avoided. In the exemplary embodiment of FIG. 11, this annular slide is modified once again, in that in addition, analogously to the version of FIG. 2, a notch 74 is again provided in the part of the pump piston immediately adjacent the part carrying the end face 129 of the exemplary embodiment of FIG. 10. As in the exemplary embodiment of FIG. 10, Once again the annular wall 34 located at the same distance from the pump piston surface is formed, as a second deflection face provided here in addition to the deflection face 134.

In addition, the collar 77 is available as a suitable support face when an exact control edge 30 is produced by means of treatment of the end face 129.

Figure 12:
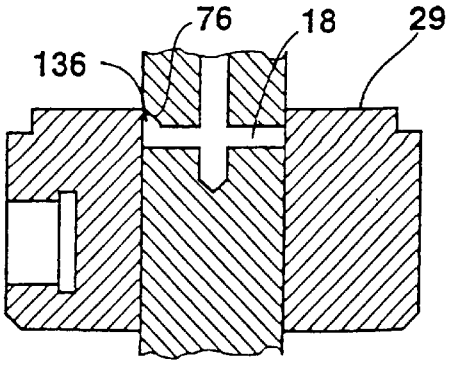
FIG. 12 shows an eleventh exemplary embodiment with a deflection face provided in the region of the outlet opening of the radial bore.

In the exemplary embodiment of FIG. 12, finally, unlike the previous embodiments, the deflection face is provided on the pump piston itself. In a modification of the form of the outlet of the radial bore with the expanded portion 36 of FIG. 2, an expanded portion 136 is now provided, which has a wall 76 inclined toward the pump piston surface; this wall has the property of deflecting the fuel stream, emerging from the radial bore 18, out of the radial plane represented by the surface 29 of the annular slide, in such a way that no flow-dictated negative pressure zones with axial exertion of force can arise between the diversion stream and the annular slide. The inclined face 76 here represents the deflection face, analogous to the deflection faces on the slide.

The foregoing relates to preferred exemplary embodiments of the invention, it being understood that other variants and embodiments thereof are possible within the spirit and scope of the invention, the latter being defined by the appended claims.

What is claimed is:

1. A fuel injection pump comprising a pump piston (1), a pump cylinder (2), a pump work chamber (3) enclosed in said pump cylinder, a cam drive that drives said pump piston to simultaneously reciprocate and rotate, said pump piston includes an end portion that protrudes out of the pump cylinder (2) into a diversion chamber (4), an annular slide (20) supported on said protruding end portion of said piston, said annular slide (20) is adjustable, relative to the pump piston (1) by means of a final control element (26(), that engages the annular slide, of a governor (22) that controls an injection quantity per supply stroke of the pump piston, in such a way that upon a pump piston supply stroke that decreases the volume of the work chamber (3), a relief conduit (12) of the pump work chamber (3) that discharges at a jacket face of the pump piston via a radial bore (18) in said pump piston is uncovered earlier or later by means of a control edge (30) disposed on the annular slide (20), a deflection face (34) is formed by a groove (58), which is machined into an inner annular groove beginning at an inner portion (19) of the annular slide (20), and the control edge (30) while a boundary wall (60) is shortened from the face end, forming an outlet cross section (62) between the boundary wall (60) and the pump piston (1), and a groove bottom (65) that serves as the deflection face.

2. A fuel injection pump comprising a pump piston (1), a pump cylinder (2), a pump work chamber (3) enclosed in said pump cylinder, a cam drive that drives said pump piston to simultaneously reciprocate and rotate, said pump piston includes an end portion that protrudes out of the pump cylinder (2) into a diversion chamber (4), an annular slide (20) supported on said protruding end portion of said piston, said annular slide (20) is adjustable, relative to the pump piston (1) by means of a final control element (26), that engages the annular slide, of a governor (22) that controls an injection quantity per supply stroke of the pump piston, in such a way that upon a pump piston supply stroke that decreases the volume of the work chamber (3), a relief conduit (12) of the pump work chamber (3) that discharges at a jacket face of the pump piston via a radial bore (18) in said pump piston is uncovered earlier or later by means of a control edge (30) disposed on the annular slide (20), a deflection face (134) is formed by a radially outer boundary wall of a recess (73), made in the face end of the annular slide, which recess is defined on another side by a part (129), carrying the control edge (30), of the end face of the annular slide, and a second deflection face (34) is provided on the annular slide, formed by a radial boundary wall of a notch (74) adjacent to the inner bore, and an axially pointing shoulder of the notch together with the inner bore forms the control edge.

3. A fuel injection pump comprising a pump piston (1), a pump cylinder (2), a pump work chamber (3) enclosed in said pump cylinder, a cam drive that drives said pump piston to simultaneously reciprocate and rotate, said pump piston includes an end portion that protrudes out of the pump cylinder (2) into a diversion chamber (4), an annular slide (20) is supported on said protruding end portion of said piston, said annular slide (20) is adjustable, relative to the pump piston (1) by means of a final control element (26), that engages the annular slide, of a governor (22) that controls an injection quantity per supply stroke of the pump piston, in such a way that upon a pump piston supply stroke that decreases the volume of the work chamber (3), a relief conduit (12) of the pump work chamber (3) that discharges at a jacket face of the pump piston via a radial bore (18) in said pump piston is uncovered earlier or later by means of a control edge (30) disposed on the annular slide (20), said control edge is formed at a transition from an inner bore (19) in said annular slide (20) in which the pump piston (1) operates to a plane corresponding with an end face (29) of the annular slide (20) in which the plane is perpendicular to an axis of the pump piston, a radial deflection face (34) that is perpendicular to the end face (29) deflects a diversion stream, emerging from the radial bore, out of a radial plane the deflection face (34) is disposed on the end face (29) of the annular slide (20) at right angles to an annular face (35) of said annular slide (20), in a form of an annular wall that surrounds the pump piston and disposed at a constant distance from said pump piston, the annular face (35) and the annular wall (34) are formed by means of a notch (31) into the end face (29) of the annular slide (20), and a shoulder is formed on the end face (29) of the annular slide (20) on an outer circumference, said shoulder changes, via a face (38) inclined at an angle, into a portion of the end face (29) that has the notch (31).

4. A fuel injection pump comprising a pump piston (1), a pump cylinder (2), a pump work chamber 3 enclosed is said pump cylinder, a cam drive to simultaneously reciprocate and rotate, said pump piston includes an end portion that protrudes out of the pump cylinder (2) into a diversion chamber (4), an annular slide (20) is supported on said protruding end portion of said piston, said annular slide (20) is adjustable, relative to the pump piston (1) by means of a final control element (26), that engages the annular slide, of a governor (22) that controls an injection quantity per supply stroke of the pump piston, in such a way that upon a pump piston supply stroke that decreases the volume of the work chamber (3), a relief conduit (12) of the pump work chamber (3) that discharges at a jacket face of the pump piston via a radial bore (18) in said pump piston is uncovered earlier or later by means of a control edge (30) disposed on the annular slide (20), said control edge is formed at a transition from an inner bore (19) in said annular slide (20) in which the pump piston (1) operates to a plane corresponding with an end face (29) of the annular slide (20) in which the plane is perpendicular to an axis of the pump piston, a radial deflection face (34) that is perpendicular to the end face (20) deflects a diversion stream, emerging from the radial bore, out of a radial plane the deflection face (34) is disposed on the end face (29) of the annular slide at right angles to the annular face (35) of said annular slide (20), in a form of an annular wall surrounding the pump piston and disposed at a constant distance from said pump piston, the annular face (35) and the annular wall (34) are formed by a shaped part (41) mounted on an end face (29) of the annular slide (20) and firmly joined to the annular slide, the shaped part (41) has a circumferential collar (42) surrounding the annular slide (20), and has a portion (40) that partially covers the annular slide (20) with an annular disk (41) on the end face (29) of the annular slide located in the radial plane, the annular disk (41) has a thick portion (45) and a thinner portion (44), which at an outer circumference of the annular disk changes into the collar (42), and a transition from the thicker portion (45) to the thinner portion (44) of the annular disk is effected in the form of a face (38) inclined at an angle, and the pump cylinder end (39), on a side opposite the end face (29) of the annular slide (20), has a recess (56() into which a part including the deflection face (34) can plunge at the uppermost position of the annular slide (20).

5. A fuel injection pump comprising a pump piston (1), a pump cylinder (2), a pump work chamber 3 enclosed is said pump cylinder, a cam drive that drives said pump piston to simultaneously reciprocate and rotate, said pump piston includes an end portion that protrudes out of the pump cylinder (2) into a diversion chamber (4), an annular slide (20) is supported on said protruding end portion of said piston, said annular slide (20) is adjustable, relative to the pump piston (1) by means of a final control element (26), that engages the annular slide, of a governor (22) that controls an injection quantity per supply stroke of the pump piston, in such a way that upon a pump piston supply stroke that decreases the volume of the work chamber (3), a relief conduit (12) of the pump work chamber (3) that discharges at a jacket face of the pump piston via a radial bore (18) in said pump piston is uncovered earlier or later by means of a control edge (30) disposed on the annular slide (20), said control edge is formed at a transition from an inner bore (19) in said annular slide (20) in which the pump piston (1) operates to a plane corresponding with an end face (29) of the annular slide (20) in which the plane is perpendicular to an axis of the pump piston, a radial deflection face (34) that is perpendicular to the end face (29) deflects a diversion stream, emerging from the radial bore, out of a radial plane, the deflection face (34) is disposed on the end face (29) of the annular slide at right angles to the annular face (35) of said annular slide (20), in a form of an annular wall surrounding the pump piston and disposed at a constant distance from said pump piston, the annular face (35) and the annular wall (34) are formed by a shaped part (41) mounted on an end face (29) of the annular slide (20) and firmly joined to the annular slide, the shaped part is a sheet-metal part (47), having a first collar (48) formed on an inside from an annular disk (50) and a second collar (49) on an outside of the annular disk (50) that is crimped into a notch (52) in the end face (29) of the annular slide (20) and is oriented in an opposite direction axially from the first collar and the pump cylinder end (39), on a side opposite the end face (29) of the annular slide (20), has a recess (56) into which a part including the deflection face (34) can plunge at the uppermost position of the annular slide (20).

6. The fuel injection pump of claim 3, in which the diversion stream is aimed in a direction of the supply stroke motion of the pump piston (1).

7. The fuel injection pump of claim 3, in which the deflection face (34) is disposed on the end face (29) of the annular slide (20), adjacent to the annular face (35) that adjoins the control edge and is located in a radial plane.

8. The injection pump of claim 3, in which the pump cylinder end (39), on a side opposite the end face (29) of the annular slide (20), has a recess (56() into which a part including the deflection face (34) can plunge at the uppermost position of the annular slide (20).

9. The injection pump of claim 1, in which the deflection face (34) is formed by a groove (58), which is machined into an inner annular groove beginning at the inner portion (19) of the annular slide (20), and the control edge (30) is formed by one boundary wall (59) of this groove at the transition to the inner bore (19), and a radial bore (64) leads to the outside from the groove bottom (65).

10. The injection pump of claim 3, in which the deflection face is formed by a sheet-metal part (67) mounted on the end face (29) of the annular slide (20), said sheet metal part has a jacket part (68) circumferentially surrounding the annular slide (20) that is bent over onto the end face of the annular slide (20) and, after a portion of the bearing surface of the bent-over portion (69) is bent outward to an end portion (70) extending parallel to the end face, which is adjoined by a portion 73 bent over at right angles to the end face (29), forming the annular end face, pointing to the end of the pump piston, serving as an extending deflection face (72).

11. The injection pump of claim 3, in which the deflection face (134) is formed by a radially outer boundary wall of a recess (73), made in the end face of the annular slide, which recess is defined on another side by a part (129), carrying the control edge (30), of the end face of the annular slide.

* * * * *